US012714175B2

(12) United States Patent
Lieret et al.

(10) Patent No.: US 12,714,175 B2
(45) Date of Patent: Aug. 25, 2026

(54) ARRANGEMENT

(71) Applicant: UVEX ARBEITSSCHUTZ GMBH, Fürth (DE)

(72) Inventors: Roland Lieret, Weihenzell (DE); Martin Wolf, Ansbach (DE)

(73) Assignee: UVEX ARBEITSSCHUTZ GMBH, Fürth (DE)

( * ) Notice: Subject to any disclaimer, the term of this patent is extended or adjusted under 35 U.S.C. 154(b) by 0 days.

(21) Appl. No.: 18/591,125

(22) Filed: Feb. 29, 2024

(65) Prior Publication Data

US 2024/0292921 A1 Sep. 5, 2024

(30) Foreign Application Priority Data

Mar. 3, 2023 (DE) ..... 10 2023 201 935.3

(51) Int. Cl.
*A42B 3/22* (2006.01)

(52) U.S. Cl.
CPC ..... *A42B 3/222* (2013.01)

(58) Field of Classification Search
CPC ..... A42B 3/042; A42B 3/044; A42B 3/0446; A42B 3/223; A42B 3/04; A42B 3/0406; A42B 1/244
See application file for complete search history.

(56) References Cited

U.S. PATENT DOCUMENTS 4,479,738 A * 10/1984 Kubnick ..... A61F 9/06 2/10
5,091,997 A * 3/1992 Foehl ..... A42B 3/222 2/424
5,438,494 A * 8/1995 Harlan ..... F21V 21/084 362/396
6,619,813 B1 * 9/2003 Schnell ..... F21L 4/027 362/396
7,425,082 B1 * 9/2008 Jones ..... A42B 3/044 362/269

(Continued)

FOREIGN PATENT DOCUMENTS

DE 202020102624 U1 6/2021
DE 102020209772 A1 2/2022

(Continued)

OTHER PUBLICATIONS

Extended European Search Report dated Jul. 22, 2024, from corresponding application No. 24 158 797.1.

(Continued)

*Primary Examiner* — Megan E Lynch
(74) *Attorney, Agent, or Firm* — FisherBroyles, LLP; Roger L. Browdy; Ronni S. Jillions

(57) ABSTRACT

An arrangement has an adjustable face shield and a face shield holding mechanism for connection to a headgear base body as well as an adjustable object holding device associated with the face shield. The object holding device has a coupling mechanism for coupling to the headgear base body and an object holding mechanism arranged on the coupling mechanism, and is swivelable in its entirety about a first axis. The face shield and the object holding device is adjustable independently of each other. The first axis coincides with a face shield adjustment axis.

10 Claims, 7 Drawing Sheets

(56) References Cited

U.S. PATENT DOCUMENTS

| | | | | |
|---|---|---|---|---|
| 8,214,919 | B2 * | 7/2012 | Gafforio | A42B 3/223 2/6.3 |
| 8,579,478 | B2 * | 11/2013 | Cristoforo | F21V 21/145 362/427 |
| 11,160,323 | B2 * | 11/2021 | Sanders | A42B 3/225 |
| 2009/0135505 | A1 * | 5/2009 | Willey | G02B 23/125 359/815 |
| 2010/0223707 | A1 * | 9/2010 | Moyses | A42B 3/225 2/8.2 |
| 2010/0271832 | A1 | 10/2010 | Mccorkle et al. | |
| 2011/0252546 | A1 * | 10/2011 | Junker | A42B 3/04 2/422 |
| 2015/0223540 | A1 * | 8/2015 | Daniels | A42B 3/042 224/272 |
| 2017/0112225 | A1 * | 4/2017 | Gotti | A42B 3/04 |
| 2017/0325534 | A1 * | 11/2017 | Noordzij | A42B 3/223 |
| 2018/0027916 | A1 * | 2/2018 | Smallwood | A42B 3/222 |
| 2018/0128459 | A1 * | 5/2018 | Carroll | F21V 21/08 |
| 2019/0380421 | A1 * | 12/2019 | Noordzij | A42B 3/223 |
| 2020/0029645 | A1 * | 1/2020 | Salvetti | A42B 3/222 |
| 2020/0383417 | A1 * | 12/2020 | Bohn | A42B 3/225 |
| 2021/0307448 | A1 * | 10/2021 | Sanders | A42B 3/225 |
| 2022/0091424 | A1 * | 3/2022 | Baudou | G02B 27/0176 |
| 2022/0361620 | A1 * | 11/2022 | Lu | A42B 3/221 |
| 2023/0301388 | A1 * | 9/2023 | Paulson | A42B 3/225 |

FOREIGN PATENT DOCUMENTS

| | | | | |
|---|---|---|---|---|
| FR | 2637808 | A1 * | 4/1990 | |
| KR | 101477918 | B1 * | 12/2014 | |
| WO | WO-2006131558 | A1 * | 12/2006 | A42B 3/228 |

OTHER PUBLICATIONS

3M™ Head & Face Technical Datasheet—und Gehorschutzkombination G500. Neuss; 2014—Firmenschrift—abstract.

* cited by examiner

ARRANGEMENT

CROSS-REFERENCES TO RELATED APPLICATIONS

This application claims the priority of German Patent Application, Serial No. 10 2023 201 935.3, filed Mar. 3, 2023, the content of which is incorporated herein by reference in its entirety as if fully set forth herein.

FIELD OF THE INVENTION

The invention relates to an arrangement comprising a face shield and an object holding device. Furthermore, the invention is directed to a headgear comprising at least one such arrangement.

BACKGROUND OF THE INVENTION

Helmets with visors to protect the wearer and object holding devices to hold various objects are generally known from the prior art. The use or wearing of such helmets is often not user-friendly nor comfortable.

The data sheet "3M face and hearing protection combination G500", 2014, discloses a face and hearing protection combination.

From DE 10 2020 209 772 A1 a helmet adapter for half masks or respiratory masks and a helmet are known.

From DE 20 2020 102 624 U1 a helmet is known which comprises an adapter for attaching an accessory, such as a helmet lamp.

SUMMARY OF THE INVENTION

It is an object of the invention to overcome the disadvantages associated with the prior art. In particular, an arrangement shall be provided which is particularly user-friendly and extremely comfortable. A corresponding headgear shall also be provided.

According to the invention, this object is achieved by an arrangement comprising an adjustable face shield, comprising a face shield holding mechanism for connection to a headgear base body, and comprising an adjustable object holding device associated with the face shield, wherein the object holding device comprises a coupling mechanism for coupling to the head-gear base body, comprises an object holding mechanism arranged at the coupling mechanism, and is swivelable in its entirety about a first axis, wherein the face shield and the object holding device are adjustable independently of each other, wherein the first axis coincides with a face shield adjustment axis, and a headgear comprising a headgear base body, and comprising at least one arrangement according to the invention arranged at the headgear base body. The essence of the invention is the independent adjustability of the face shield and the object holding device relative to each other. For example, only the face shield is adjustable, which leaves a position or setting of the object holding device, in particular a set one, unaffected. Conversely, for example, only the object holding device is adjustable, which leaves a position or setting, in particular a set one, of the face shield unaffected. The face shield and the object holding device are not coupled in terms of adjustment. The arrangement is disposed directly or in-directly on the headgear base body in the assembled state.

The embodiment, according to which the object holding device is swivelable in its entirety about the first axis, is highly user-friendly. The object holding device is thus adjustable particularly well or in a targeted (guided) manner. The first axis preferably extends (essentially) horizontally when the arrangement or headgear is worn as intended.

The embodiment, according to which the first axis coincides with the face shield adjustment axis, is again very user-friendly. The first axis and the face shield adjustment axis preferably each form a swivel axis.

The face shield is preferably symmetrical and, when worn, is able to protect the wearer's face at least in certain regions, in particular at least the wearer's eyes, for example from hazards such as mechanical influences, light (sun), wind or the like. It is designed, for example, as a visor, shield, protective glass, screen, goggles, grid element or the like. It is expedient if the face shield is adjustable between a (lower) protective position or wearing position and an (upper) storage position. In the protective position, the face shield is preferably located (essentially) at least partially below the headgear base body. The wearer is then preferably able to see through the face shield. In the storage position, the face shield preferably covers the headgear base body at least partially and thus does not interfere. It is advantageous if the face shield has at least one viewing area and preferably at least one lateral storage area, preferably two lateral storage areas.

The headgear base body is preferably designed as a headgear shell or head-gear calotte. It is preferably symmetrical and, when worn, is able to protect the wearer's head, at least in certain regions, from mechanical influences, in particular from shocks, impacts or the like. For example, the headgear base body is shock-absorbing. For example, it is padded on the inside or has a soft lining. Alternatively, the headgear base body is designed as a hard shell, for example, and is not padded.

A chin strap arrangement is preferably arranged on the headgear base body for locally securing the headgear base body to the wearer's head.

The headgear is designed, for example, as a helmet, cap, hat, bonnet or the like. It is preferably used for work, leisure or sports.

For example, the face shield holding mechanism is able to hold the face shield in a set position. For example, it is connected in one piece to the headgear base body. Alternatively, the face shield holding mechanism is configured to be separate from the headgear base body.

The object holding mechanism is preferably designed as an object receiving mechanism. It is able to hold an object such as a lamp, light, camera, signaling means, communication means such as a loudspeaker, microphone or the like, for example in a form-fit and/or force-fit manner, preferably detachably. It is adjustable and thus, for example, adaptable in each case to the wearer or the prevailing situation.

When the arrangement is mounted, the coupling mechanism is directly or indirectly coupled to the headgear base body. It is directly or indirectly connected to the object holding mechanism. It is expedient if the object holding device is detachably arranged or arrangeable at the headgear base body.

Further advantageous embodiments of the invention are set forth in the following.

The embodiment in which the face shield and the object holding device are adjustable independently of one another in a latching manner is particularly user-friendly. The face shield and the object holding device are each adjustable in a latching manner, in particular manually. To adjust the face shield or the object holding device from the respective latching position, a corresponding latching force must be overcome. Unwanted misadjustment of the face shield or the object holding device is thus made more difficult or prevented.

The object holding device in which the object holding device is swivelable in its entirety about the first axis in a latching manner is preferably adjustable in steps or in stages. It preferably swivelable by 360° or without spatial limitation.

The at least one first latching means in which the coupling mechanism has at least one first latching means and the face shield holding mechanism has at least one first counter latching means, wherein the at least one first latching means and first counter latching means are in latching connection with one another in a latching position, is designed, for example, as a tooth, head, nub, projection or the like. The at least one first counter latching means is preferably designed as a recess, trough or the like. They are preferably (substantially) complementary to one another. It is expedient if a plurality of first counter latching means is present. Favorably, the first counter latching means are then arranged along a circular line or an arc of a circle. Alternatively, an inverted arrangement of the at least one first latching means and counter latching means is possible.

The embodiment in which the object holding mechanism is swivelable about a second axis relative to the coupling mechanism is also highly user-friendly. The second axis preferably extends differently from the first axis. More favorably, it extends perpendicularly or obliquely to the first axis. For example, the second axis extends (essentially) in a vertical plane when the arrangement or headgear is worn as intended. Adjustment or swiveling about the first and second axes is preferably possible independently of each other. The object holding device or object holding mechanism is thus adaptable particularly well to the respective wearer or the respective pre-vailing situation.

The embodiment in which the object holding mechanism is swivelable about the second axis in a latching manner relative to the coupling mechanism also prevents or impedes undesired misadjustment of the object holding mechanism relative to the coupling mechanism. A latching force must be overcome for the adjustment, in particular manually. The object holding mechanism is swivelable in stages or in steps. It is preferably swivelable about the second axis in a spatially limited manner.

It is expedient if, in in embodiment in which the coupling mechanism has at least one second latching means and the object holding mechanism has at least one second counter latching means, wherein the at least one second latching means and second counter latching means are in latching connection with one another in a latching position, the at least one second latching means is designed as a trough, recess or the like. The at least one second counter latching means is preferably designed as a tooth, head, nub, projection or the like. They are preferably (substantially) complementary to each other. It is expedient if a plurality of second latching means is present. The second latching means are preferably arranged at least along a part-circular line or a part-circular arc. Alternatively, an inverted arrangement of the at least one second latching means and counter latching means is possible.

The arrangement in which the at least one second latching means is arranged adjacent to the second axis, and preferably around the second axis is particularly functionally reliable.

The arrangement in which the face shield is swivelable in a latching manner is also very user-friendly. The face shield is adjustable safely, in particular manually, in steps or stages. For adjustment, a corresponding latching force must again be overcome, which makes undesired misadjustment of the face shield more difficult or prevents same.

The at least one third latching means of the embodiment in which the face shield has at least one third latching means and the face shield holding mechanism has at least one third counter latching means, wherein the at least one third latching means and third counter latching means are in latching connection with one another in a latching position, is preferably designed as a pin, bolt, projection or the like. It is advantageous if the at least one third counter latching means is designed as a recess, trough or the like. They are preferably (substantially) complementary to one another. It is expedient if a plurality of third counter latching means is present. The third counter latching means are preferably arranged along a part-circular line or a part-circular arc. Alternatively, an inverted arrangement of the at least one third latching means and counter latching means is possible.

The embodiment comprising a retaining body which is displaceable between a face shield retaining position and a face shield releasing position, wherein the retaining body, in the face shield retaining position, engages in a bearing body of the face shield to hold the face shield at the face shield holding mechanism, is particularly practical. The face shield is thus easily mountable or removable. It is replaceable or exchangeable, in particular without tools. The retaining body is preferably displaceable, preferably slidable, against a spring force or restoring force.

The headgear in which the coupling mechanism passes through the face shield when mounted and engages in the face shield holding mechanism is very user-friendly and functionally reliable. This design is space-saving and requires only a small installation space.

In the following, a preferred embodiment of the invention is described by way of example with reference to the attached drawing.

DESCRIPTION OF THE PREFERRED EMBODIMENT

Figure 1:
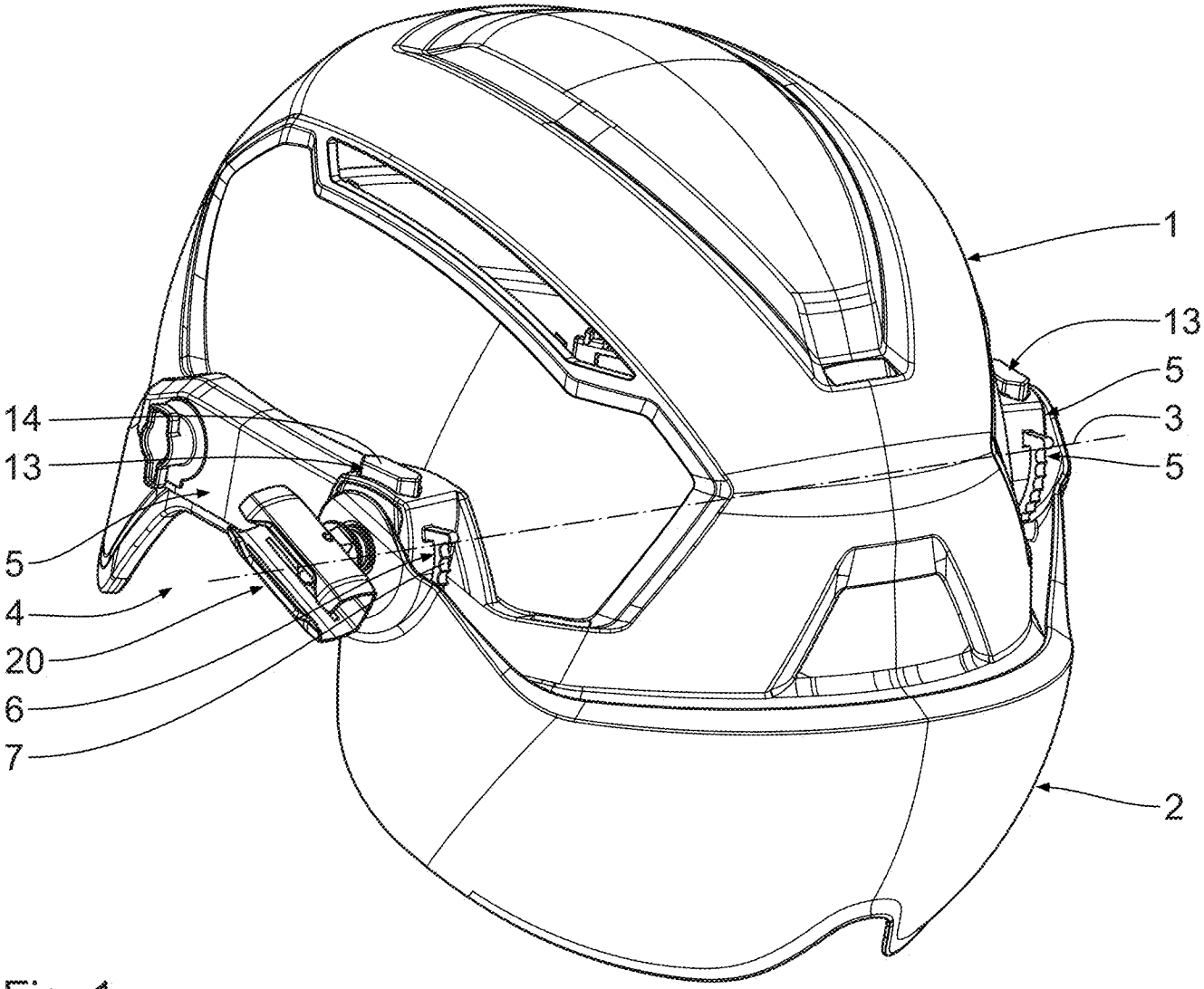
FIG. 1 shows a perspective view of a headgear comprising an arrangement according to the invention.
Figure 2:
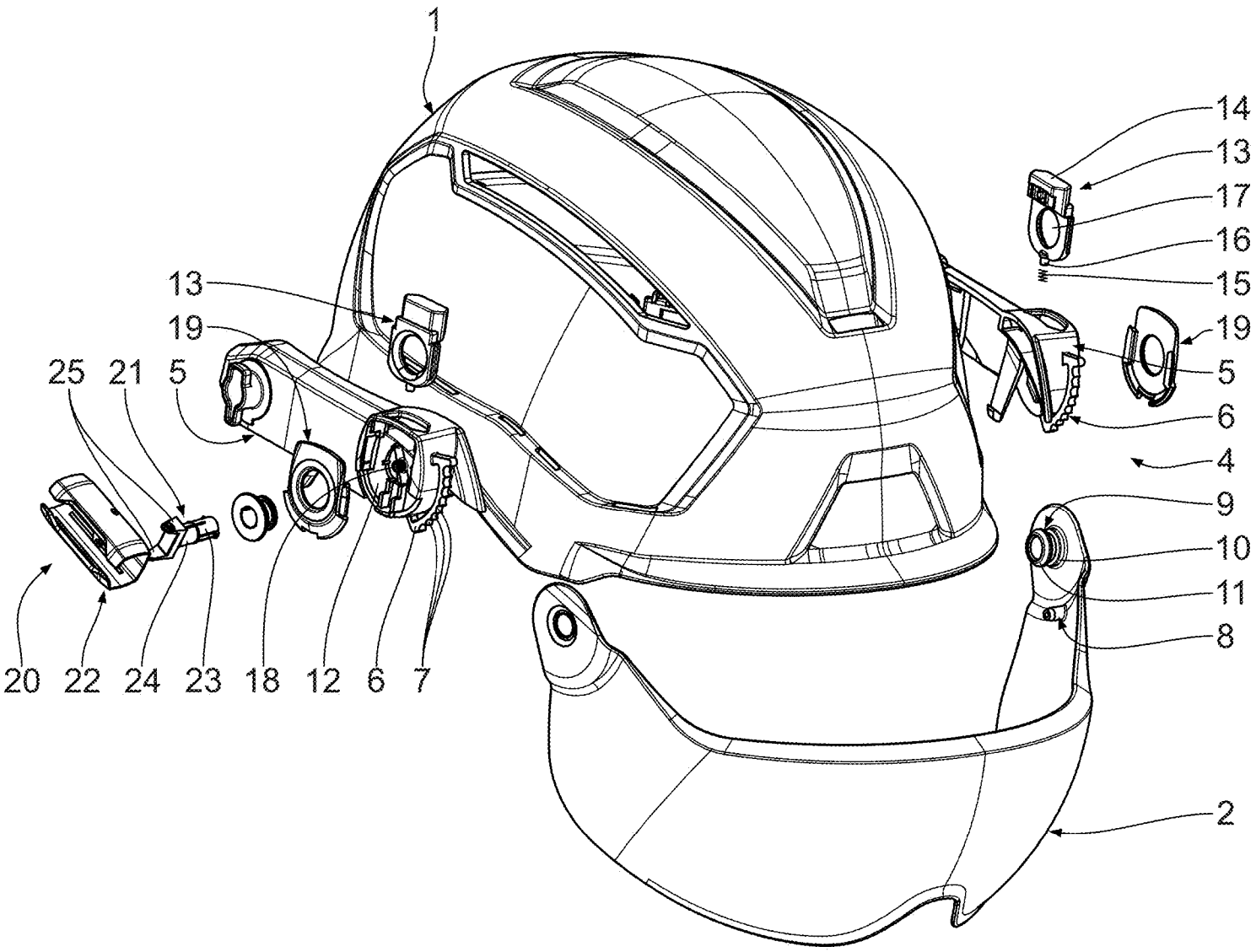
FIG. 2 shows an exploded view of the headgear illustrated in FIG. 1.
Figure 3:
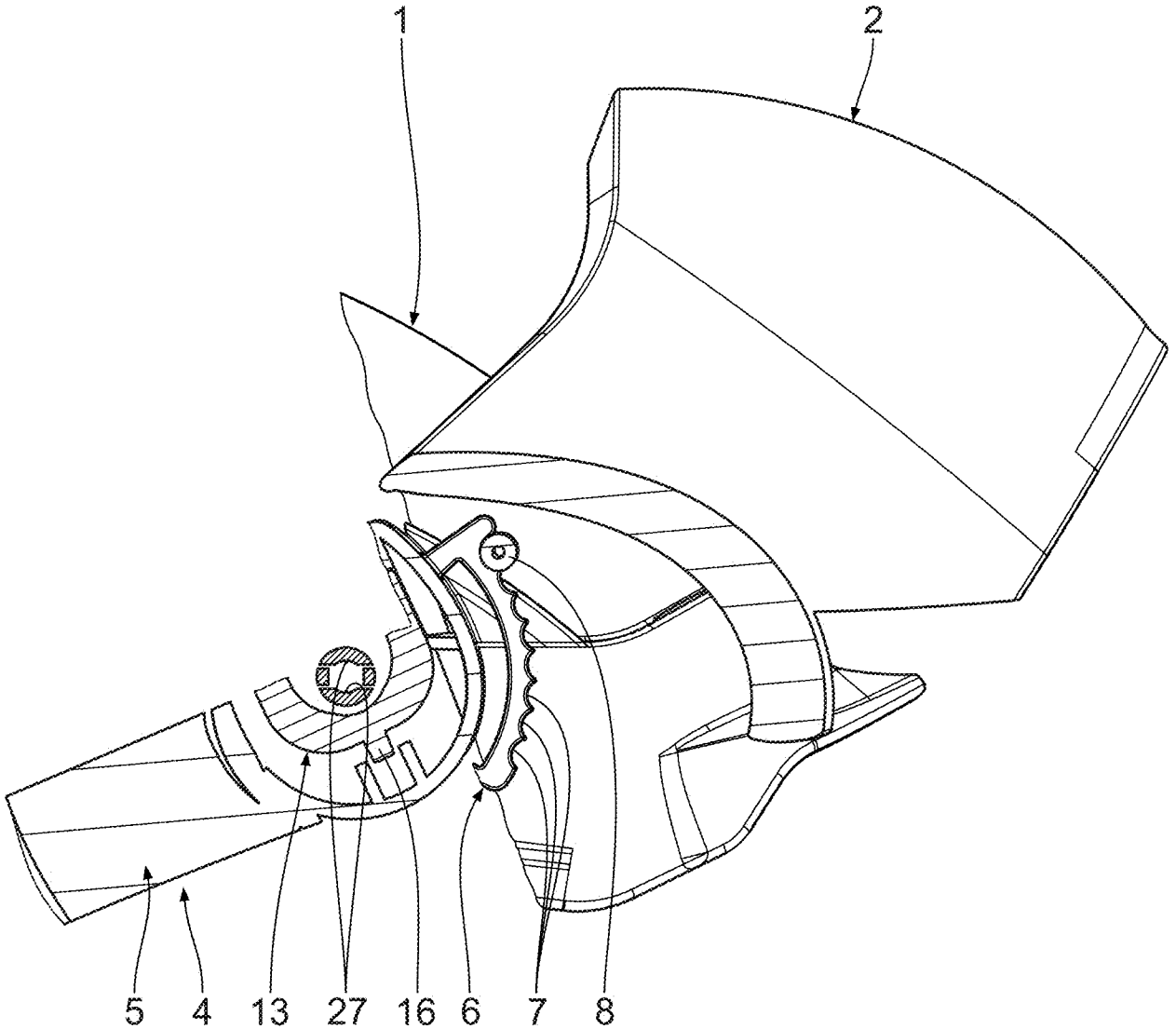
FIG. 3 shows a partial view of the headgear shown in FIGS. 1, 2, showing in particular the face shield in a storage position.
Figure 4:
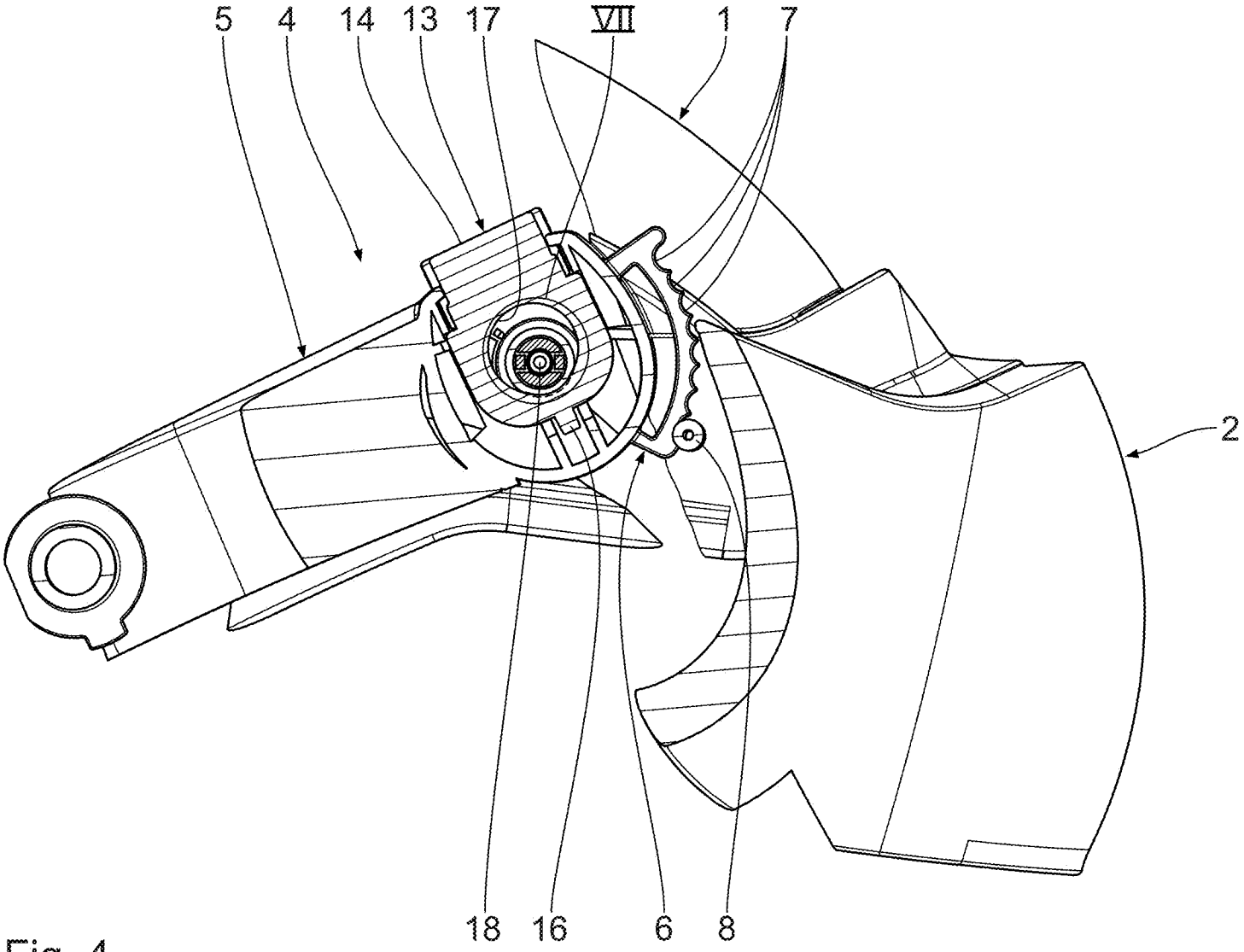
FIG. 4 shows essentially the view shown in FIG. 3, wherein the face shield is in its protective position.
Figure 5:
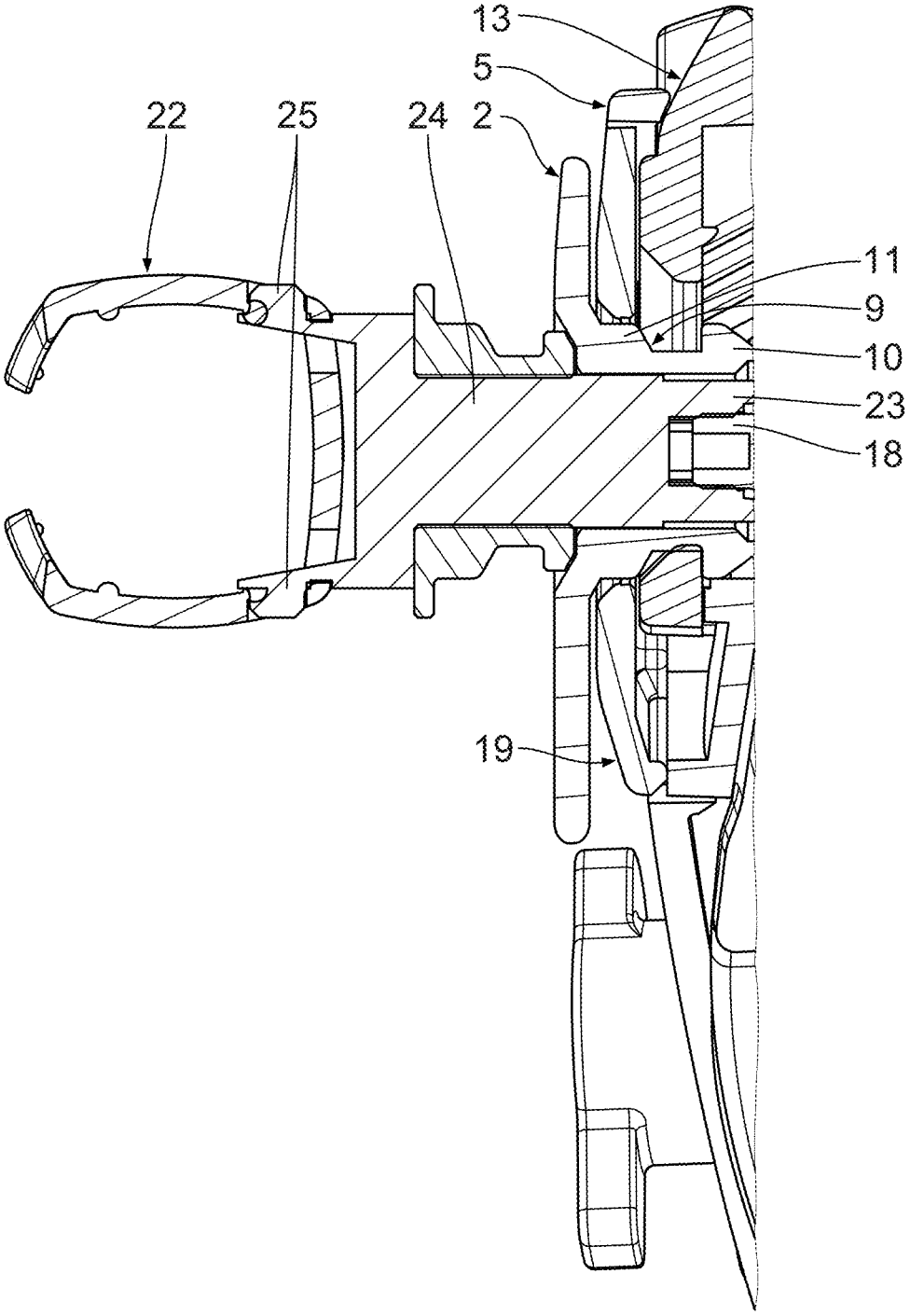
FIG. 5 shows essentially a longitudinal section through the arrangement shown.
Figure 6:
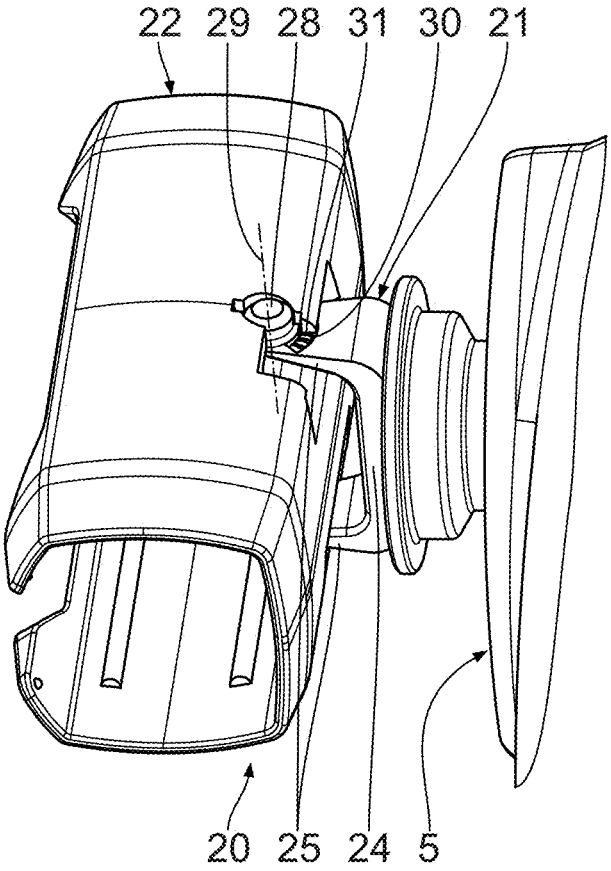
FIG. 6 shows an enlarged perspective view illustrating the object holding mechanism and partially the coupling mechanism of the arrangement shown.

A headgear shown in its entirety in FIGS. 1, 2 comprises a shell-like helmet calotte 1 and a visor 2, which are displaceable in a swiveling manner relative to the helmet calotte 1 about a visor swivel axis 3.

The helmet calotte 1 is rigid. It serves to cover at least part of the head of a wearer (not shown). It is preferably symmetrical.

A visor holding mechanism 4, for example by means of notches, in particular latching bars, is arranged on the outside of each side of the helmet calotte 1. The visor holding mechanisms 4 are arranged opposite each other and are identical in design, for example.

Each visor holding mechanism 4 has a one-piece main body 5. Each main body 5 is of elongate design and, when mounted, extends adjacent to a lower lateral edge of the helmet calotte 1.

Each main body 5 carries a latching bow body 6 at the front with several latching recesses 7 arranged along the latching bow body 6. The latching recesses 7 are of identical design. They face forwards or forwards and downwards or are open.

The visor 2 is made of plastic and is preferably designed in one piece. It is preferably transparent and can be tinted. The visor 2 has a pin-like or bolt-shaped visor latching projection 8 on the inside of each side. Each visor latching projection 8 has a circular outer contour in cross-section. The outer contour is (substantially) complementary to the latching recesses 7. When the headgear is assembled or mounted, the visor latching projections 8 each engage with a latching recess 7 of the visor holding mechanisms 4, whereby the visor 2 is held in a corresponding position in a releasable latching manner.

To form the visor swivel axis 3, the visor 2 carries a hollow cylinder body 9 on the inside of each side. Each hollow cylinder body 9 has a foot 10 and a free head 11 with an insertion bevel. Each hollow cylinder body 9 is tapered on the outside or circumferentially between the foot 10 and head 11, forming a locking mechanism.

Each main body 5 has a bearing receptacle 12 adjacent to its latching bow body 6. Each bearing receptacle 12 is open laterally outwards and upwards.

Each visor holding mechanism 4 comprises a, preferably plate-like, retaining body 13, which is displaceably guided in the respective bearing receptacle 12. Each retaining body 13 has an actuation button 14 at the top which, in the initial position of the respective retaining body 13, passes upwards through the adjacent main body 5.

At least one return spring mechanism 15, for example in the form of a helical spring, is arranged between each retaining body 13 and the adjacent main body 5. Each return spring mechanism 15 is supported here on the floor side relative to the associated main body 5 and is located below the corresponding retaining body 13. Each main body 5 has two boundary walls adjacent to the corresponding return spring mechanism 15, for example to prevent lateral deflection thereof.

Each retaining body 13 has a central connector projection 16 at the bottom, which engages in the adjacent return spring mechanism 15 from above. It also has a continuous circular retaining opening 17 between the actuation button 14 and the connector body 16, which is completely closed on the circumferential side.

Each visor holding mechanism 4 comprises a cylindrical bearing pin 18 projecting laterally outwards in the region of its bearing receptacle 12.

In addition, each visor holding mechanism 4 has a closure 19 which, in its closed position, covers the adjacent bearing pin 18, the return spring mechanism 15 and the return body 13 on the outside. Each closure 19 is securable to the associated main body 5 in a form-fit and/or force-fit manner. For example, it is slidably guided on the associated main body 5.

When the visor 2 is mounted, each visor side region covers a closure 19 on the outside. The respective hollow cylinder body 9 passes through the adjacent closure 19 and the retaining opening 17 of the retaining body 13 from the lateral outside. The adjacent bearing pin 18 engages in the hollow cylinder body 9 from the inside. The at least one return spring mechanism 15 presses the return body 13 upwards so that the latter engages in the tapered region of the hollow cylinder body 9 between its foot 10 and head 11, i.e. in the locking mechanism thereof, in particular from below, whereby the hollow cylinder body 9 is fixed in position axially relative to the corresponding visor holding mechanism 4 and is nevertheless mounted there in a swiveling manner. The visor 2 is thus held on the corresponding visor holding mechanism 4.

When the visor 2 is swiveled around the visor swivel axis 3, the visor latching projections 8 slide over the latching recesses 7 arranged one behind the other, overcoming latching forces that hold the visor 2 in the corresponding latching positions. The hollow cylinder bodies 9 are swiveled in relation to the retaining bodies 13 and the bearing pins 18.

To release the visor 2 from the visor holding mechanisms 4, the actuation buttons 14 are manually pressed downwards from the initial or retaining position, whereby the retaining bodies 13 are displaced downwards with compression of the return spring mechanisms 15. The retaining bodies 13 are thus disengaged from the hollow cylinder bodies 9 so that the retaining bodies 9 are guidable freely and axially outwards out of the visor holding mechanisms 4. If there is no corresponding pressure force on the actuation buttons 14, the return spring mechanisms 15 push the retaining bodies 13 back upwards from the release position into their retaining position.

The headgear also comprises an object holding device 20, which is arranged laterally on the helmet calotte 1. The object holding device 20 is adjustable and capable of holding an object (not shown), such as a lamp.

The object holding device 20 has a coupling mechanism 21 and an object holding mechanism 22.

The coupling mechanism 21 is formed in one piece and has a cylindrical bearing foot 23 which is hollow at least adjacent to its free end. The bearing foot 23 has at least one longitudinal slot, which allows the outer diameter of the bearing foot 23 to be changed for assembly/disassembly. It also comprises at least one outer latching projection adjacent to its free end.

Adjacent to the bearing foot 23, the coupling mechanism 21 has an outer stop body 24, which forms an annular projection.

The coupling mechanism 21 also has two parallel and spaced-apart bearing arms 25, which project axially outwards in relation to the stop body 24. The stop body 24 is arranged between the bearing arms 25 and the bearing foot 23.

Figure 7:
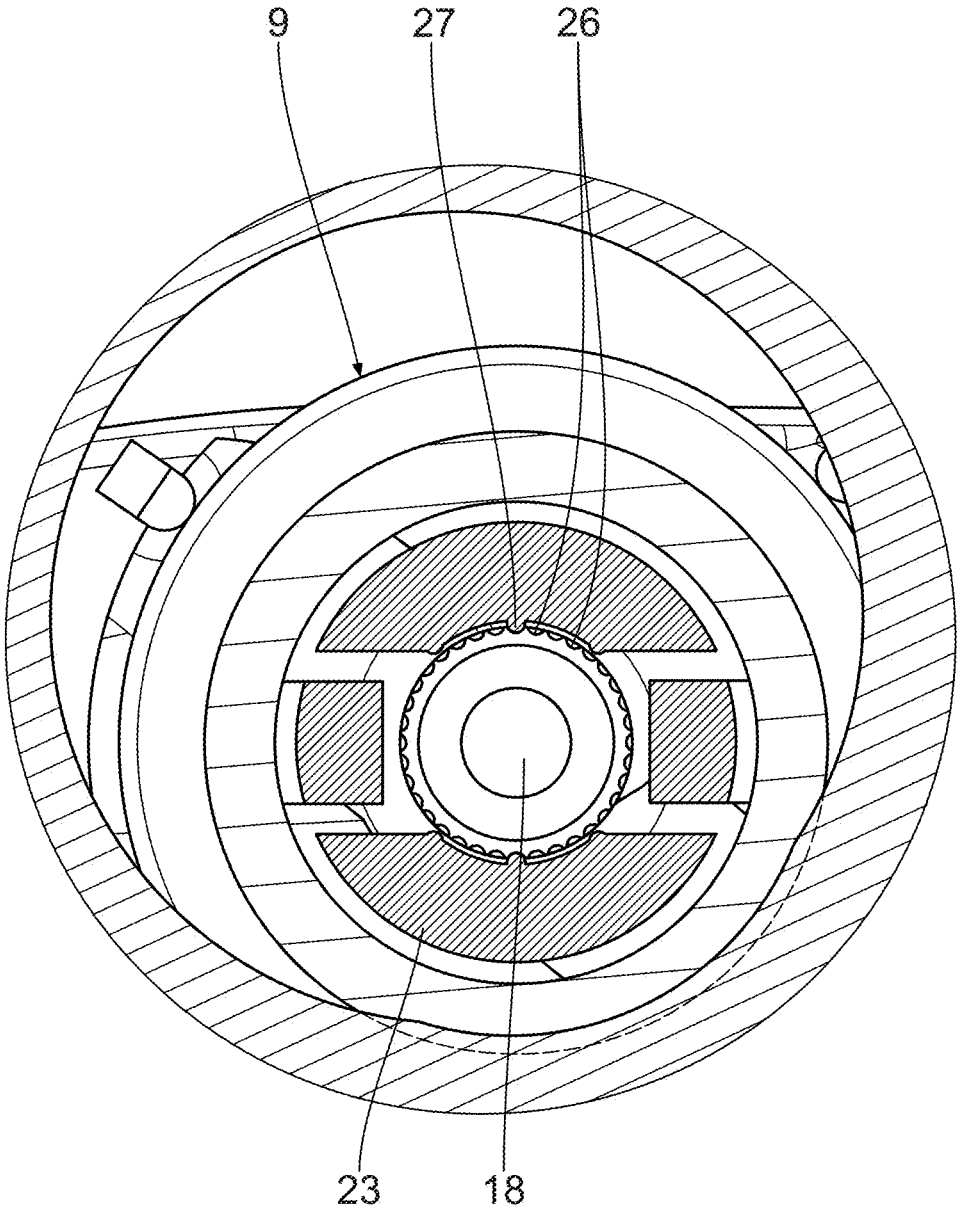
FIG. 7 shows a partial view of the arrangement, showing in particular first latching means and counter latching means of the arrangement.

At least the main body 5, which is arranged adjacent to the object holding device 20, has on the outside of its bearing pin 18 a plurality of bearing foot latching recesses 26 (FIG. 7), which are open to the outside laterally and extend over the entire circumference of the bearing pin 18. The bearing foot 23 has two latching projections 27 on the inside, which are arranged opposite each other and project inwards toward one another. Alternatively, a different number of latching projections 27 is possible.

When the bearing foot 23 is inserted axially from the lateral outside into the corresponding hollow cylinder body 9 for mounting, the bearing foot 23 is compressed.

When mounted, the bearing foot 23 passes through the adjacent hollow cylinder body 9 and engages behind the latter in a latching manner. It passes through the visor 2 and engages with the hollow cylinder body 9 in the visor holding mechanism 4. The stop body 24 rests on the outside of the visor 2 adjacent to the corresponding hollow cylinder body 9. The object holding mechanism 22 is thus arranged on the outside of the visor 2. The bearing pin 18 engages axially in the bearing foot 23. The latching projections 27 engage from the lateral outside into the bearing foot latching recesses 26. The object holding device 20 is thus swivelable in its entirety about the visor swivel axis 3 in a latching manner. When swiveled accordingly, the object holding device 20 is swiveled relative to the adjacent visor holding mechanism 4 and the visor 2. In the process, the latching projections 27 slide over the bearing foot latching recesses 26 and engage with the latter in a latching manner. A corresponding latching force must be overcome for swiveling.

To release the bearing foot 23 from the hollow cylinder body 9, the latching force is overcome by the at least one latching projection engaging behind the hollow cylinder body 9.

The object holding mechanism 22 is designed as a hollow body. It is preferably designed in one piece and is clip-like, for example. An object to be held can be releasably inserted into the object holding mechanism 22 and fixed in position there.

The object holding mechanism 22 is pivotably mounted on the bearing arms 25. Each bearing arm 25 has an outer bearing head 28. The bearing heads 28 are arranged facing away from each other at the bearing arms 25. They are aligned with each other and form a (second) swivel axis 29. At least adjacent to a bearing head 28, a plurality of bearing arm latching recesses 30 are arranged on the outside of the corresponding bearing arm 25 on an arcuate line around the swivel axis 29, which is limited at the end. The bearing arm latching recesses 30 face outwards. The object holding mechanism 22 has at least one latching projection 31 on the inside, adjacent to the bearing arm latching recesses 30, which is in engagement in each case with a bearing arm latching recess 30.

When the object holding mechanism 22 is swiveled relative to the bearing arms 25 about the swivel axis 29, the latching projection 31 slides over the bearing arm latching recesses 30, overcoming a corresponding latching force.

The swiveling of the object holding mechanism 22 about the swivel axis 29 is possible independently of the swiveling of the object holding device 20 about the visor swivel axis 3. Furthermore, the swiveling movements of the entire object holding device 20 and the object holding mechanism 22 can be carried out independently of the swiveling of the visor 2. If there is only an adjustment of the visor 2, the object holding device 20 or object holding mechanism 22 remains stationary. It does not move with it.

The bearing foot latching recesses 26 form first counter latching means, while the latching projections 27 form first latching means. The bearing arm latching recesses 30 form second latching means, while the at least one latching projection 31 forms a second counter latching means. The visor latching projections 8 form third latching means, while the latching recesses 7 form third counter latching means.

The expressions "front", "rear", "bottom", "top", "inside", "outside" or the like given here refer to the arrangement of the headgear when it is worn as intended.

What is claimed is:

1. An arrangement comprising: an adjustable face shield, a face shield holder configured to be connected to a headgear base body, and an adjustable first object holder to adjustably connect the face shield to the headgear base body, wherein the adjustable first object holder comprises: a coupler configured to be coupled to the headgear base body, the coupler comprising a first plurality of latching recesses, a second object holder configured to be connected to a first end of the coupler, the second object holder comprising a first latching projection configured to engage in one of the first plurality of latching recesses as the first object holder is swiveled about a first axis, and wherein the first object holder is swivelable in its entirety about a first axis in a latching manner when the first latching projection engages with the first plurality of latching recesses, wherein the face shield holder comprises a main body configured to be connected to the headgear base body, the main body comprising a second plurality of latching recesses, wherein the face shield comprises a second latching projection configured to engage in one of the second plurality of latching recesses as the face shield is swiveled about a face shield adjustment axis, wherein the face shield and the first object holder are swivelable independently of each other, wherein the first axis coincides with the face shield adjustment axis, and wherein the face shield is swivelable in a latching manner when the second latching projection engages with the second plurality of latching recesses.

2. The arrangement according to claim 1, wherein the face shield and the first object holder are stepwise adjustable independently of one another.

3. The arrangement according to claim 1, wherein the second object holder is swivelable about a second axis relative to the coupler.

4. The arrangement according to claim 3, wherein a second end of the coupler comprises bearing arms, the bearing arms comprising a plurality of third latching recesses, the second object holder comprising a third latching projection configured to engage in one of the third plurality of latching recesses as the second object holder is swiveled about the second axis relative to the coupler.

5. The arrangement according to claim 4, wherein the first plurality of latching recesses are arranged adjacent to the second axis.

6. The arrangement according to claim 4, wherein the first plurality of latching recesses are arranged around the second axis.

7. The arrangement according to claim 1, comprising a retainer which is displaceable between a face shield retaining position and a face shield releasing position, wherein the retainer, in the face shield retaining position, engages in a bearing of the face shield to hold the face shield at the face shield holder.

8. A headgear comprising: a headgear base body, and at least one arrangement arranged at the headgear base body, the at least one arrangement comprising: an adjustable face shield, a face shield holder configured to be connected to a headgear base body, and an adjustable first object holder to adjustably connect the face shield to the headgear base body, wherein the first object holder comprises: a coupler configured to be coupled to the headgear base body, the coupler comprising a first latching projection, a second object holder configured to be connected to a first end of the coupler, the second object holder comprising a first plurality of latching recesses configured to be engaged by the first latching projection as the first object holder is swiveled about a first axis, and wherein the first object holder is swivelable in its entirety about a first axis in a latching manner when the first latching projection engages with the first plurality of latching recesses, wherein the face shield holder comprises a main body configured to be connected to the headgear base body, the main body comprising a second latching projection, wherein the face shield comprises a second plurality of latching recesses configured to be engaged by the second latching projection as the face shield is swiveled about a face shield adjustment axis, wherein the face shield and the first object holder are adjustable independently of each other, wherein the first axis coincides with the face shield adjustment axis, and wherein the face shield is swivelable in a latching manner when the second latching projection engages with the second plurality of latching recesses.

9. The headgear according to claim 8, wherein the coupler passes through the face shield when mounted and engages in the face shield holder.

10. An arrangement comprising: an adjustable face shield, a face shield holder configured to be connected to a headgear base body, and an adjustable first object holder to adjustably connect the face shield to the headgear base body, wherein the adjustable first object holder comprises: a coupler configured to be coupled to the headgear base body, the coupler comprising a first plurality of latching recesses, a second object holder configured to be connected to a first end of the coupler, the second object holder comprising a first latching projection configured to engage in one of the first plurality of latching recesses as the first object holder is swiveled about a first axis, and wherein the first object holder is swivelable in its entirety about a first axis in a latching manner when the first latching projection engages with the first plurality of latching recesses, wherein the face shield holder comprises a main body configured to be connected to the headgear base body, the main body comprising a second latching projection, wherein the face shield comprises a second plurality of latching recesses configured to be engaged by one of the second plurality of latching recesses as the face shield is swiveled about a face shield adjustment axis, wherein the face shield and the first object holder are swivelable independently of each other, wherein the first axis coincides with the face shield adjustment axis, and wherein the face shield is swivelable in a latching manner when the second latching projection engages with the second plurality of latching recesses.

* * * * *